US010470572B1

(12) United States Patent
Chen

(10) Patent No.: US 10,470,572 B1
(45) Date of Patent: Nov. 12, 2019

(54) LOCKING DEVICE FOR SLIDE RAIL

(71) Applicant: MARTAS PRECISION SLIDE CO., LTD., New Taipei (TW)

(72) Inventor: Wan-Lai Chen, New Taipei (TW)

(73) Assignee: MARTAS PRECISION SLIDE CO., LTD., New Taipei (TW)

( * ) Notice: Subject to any disclaimer, the term of this patent is extended or adjusted under 35 U.S.C. 154(b) by 0 days.

(21) Appl. No.: 16/154,381

(22) Filed: Oct. 8, 2018

(51) Int. Cl.

| | |
|---|---|
| ***A47B 88/00*** | (2017.01) |
| ***A47B 88/473*** | (2017.01) |
| ***A47B 88/483*** | (2017.01) |
| ***E05B 65/466*** | (2017.01) |

(52) U.S. Cl.
CPC ..... *A47B 88/473* (2017.01); *A47B 88/483* (2017.01); *E05B 65/466* (2013.01); *A47B 2210/0018* (2013.01)

(58) Field of Classification Search
CPC ..... E05B 65/466; E05B 65/46; E05B 53/003; E05B 65/462; E05B 65/463; E05B 65/464
USPC ..... 312/215–222, 333
See application file for complete search history.

(56) References Cited

U.S. PATENT DOCUMENTS 1,472,841 A * 11/1923 Hunt ..... E05B 65/462 312/221
2,240,067 A * 4/1941 Bolesky ..... E05B 65/463 312/221
2,559,579 A * 7/1951 Abrahamson ..... E05B 65/462 312/219
3,900,236 A * 8/1975 Goulish ..... E05B 65/464 312/217
4,168,103 A * 9/1979 Hagen ..... E05B 65/462 312/219
5,427,445 A * 6/1995 Mitchell ..... E05B 53/003 312/215
5,988,778 A * 11/1999 Lammens ..... E05B 65/464 312/217
6,186,606 B1 * 2/2001 Krei ..... E05B 65/46 312/221

(Continued)

FOREIGN PATENT DOCUMENTS

CA 2992608 * 3/2019
DE 2740816 * 3/1979

(Continued)

*Primary Examiner* — Janet M Wilkens
(74) *Attorney, Agent, or Firm* — Li & Cai Intellectual Property (USA) Office

(57) ABSTRACT

A locking device for a slide rail includes a slide rail, a locking mechanism, and a driving mechanism. The slide rail has an outer rail and an inner rail, the inner rail being capable of moving to a retracted position and an extended position relative to the outer rail along opposite directions. The locking mechanism includes a slide member, a fastening member, and a stopping part formed on the slide member, the slide member being capable of moving to a fastening position and a released position along opposite directions. The driving mechanism includes a traction mechanism and a pull cord connecting the traction mechanism and the slide member. When the locking mechanism is in a locked state, the fastening member is obstructed by the stopping part, and when the locking mechanism is in an unlocked state, the stopping part does not obstruct the fastening member.

9 Claims, 13 Drawing Sheets

(56) References Cited

U.S. PATENT DOCUMENTS

| | | | | |
|---|---|---|---|---|
| 6,217,139 | B1 * | 4/2001 | Henriott | A47B 21/06 312/219 |
| 7,320,507 | B2 * | 1/2008 | White | E05B 65/464 312/221 |
| 7,850,259 | B2 * | 12/2010 | Chen | E05B 65/466 312/221 |
| 8,371,664 | B1 * | 2/2013 | Chen | A47B 88/43 312/218 |
| 8,651,591 | B1 * | 2/2014 | Chen | E05B 65/462 312/218 |
| 2004/0100165 | A1 * | 5/2004 | Hoffman | E05B 65/466 312/219 |
| 2005/0104485 | A1 * | 5/2005 | Chiu | E05B 65/464 312/221 |
| 2006/0249643 | A1 * | 11/2006 | Weng | E05B 65/463 248/424 |
| 2006/0267461 | A1 * | 11/2006 | Hoffman | E05B 65/466 312/219 |
| 2009/0102339 | A1 * | 4/2009 | Weng | E05B 65/463 312/333 |
| 2012/0068590 | A1 * | 3/2012 | Chen | E05B 65/464 312/333 |

FOREIGN PATENT DOCUMENTS

| | | | |
|---|---|---|---|
| DE | 4416768 | * | 11/1994 |
| EP | 1340874 | * | 9/2003 |
| FR | 2158745 | * | 6/1973 |

* cited by examiner

LOCKING DEVICE FOR SLIDE RAIL

FIELD OF THE DISCLOSURE

The present disclosure relates to a locking device for a slide rail, and more particularly to a locking device for slide rails of drawers or server housings.

BACKGROUND OF THE DISCLOSURE

Conventionally, cabinets or server housings rely on a plurality of slide rails to allow drawers or server casings disposed therein to slide in or slide out.

To prevent such server housings from being involuntarily opened, a locking device is usually incorporated for fixing the server casings in place. This locking device generally includes locking mechanisms that correspond to the drawers or casings, a lock core, and a transmission rod that is connected between the lock core and the locking mechanisms.

However, locking devices of conventional server housings generally adopt transmission rods made of hard metal to synchronously drive the lock cores and locking mechanisms. This kind of transmission rod not only has a complex structure and occupies significant space, but also cannot be adjusted in terms of positioning and orientation according to the spatial arrangement within the server housing.

Due to the abovementioned inconveniences associated with the related art, there is still room for improvement in the relevant industry.

SUMMARY OF THE DISCLOSURE

In response to the above-referenced technical inadequacies, the present disclosure provides a locking device for a slide rail that has a different structure and spatial disposition from a conventional locking device.

In one aspect of the present disclosure, the locking device for a slide rail includes a slide rail, a locking mechanism, and a driving mechanism.

The slide rail has an outer rail and an inner rail, the inner rail is capable of moving to a retracted position relative to the outer rail along a first direction that is parallel to the longitudinal direction of the slide rail, and moving to an extended position relative to the outer rail along a second direction that is opposite to the first direction.

The locking mechanism includes a slide member, a fastening member, and a stopping part formed on the slide member. The slide member is disposed at the outer rail, the fastening member is disposed at the inner rail, and the slide member is capable of moving to a fastened position along a third direction that is perpendicular to the longitudinal direction of the slide rail, and moving to a released position along a fourth direction opposite to the third direction.

The driving mechanism includes a traction mechanism and at least one pull cord connecting the traction mechanism and the slide member, the traction mechanism driving the slide member through the pull cord such that the slide member moves to one of the fastened position and the released position. When the locking mechanism is in a locked state, the slide member moves to the fastened position, the inner rail moves to the retracted position, and the fastening member is located at a side of the stopping part directed toward the first direction, so that the fastening member is obstructed by the stopping part when moving along the second direction; and when the locking mechanism is in an unlocked state, the slide member moves to the released position, and the stopping part moves to a position which does not obstruct the fastening member.

In an exemplary embodiment of the present disclosure, the outer rail has an outer main board, and two outer side boards respectively connected to two opposite long sides of the outer main board. The outer main board and the two outer side boards co-define an outer guide groove, and the inner rail is accommodated in the outer guide groove. Each of the outer side boards of the outer rail is formed with a guide hole, the two guide holes are opposite to each other, and the slide member passes through the two guide holes and is limited by the two guide holes to move back and forth along a direction perpendicular to the longitudinal direction of the slide rail.

In an exemplary embodiment of the present disclosure, a fixing ring is disposed respectively at the two ends of each of the at least one pull cords and interlocking cords, a hook is disposed respectively at two ends in the third or fourth directions of each of the slide members, and the two ends of each of the slide members are respectively connected with the fixing rings of the at least one pull cords or the interlocking cords through the hooks.

In an exemplary embodiment of the present disclosure, the traction mechanism includes a lock core having a rotation shaft, and a connecting member. The connecting member is connected to the rotation shaft and has at least one connecting part, central axes of the at least one connecting part and the rotation shaft not sharing a same center of axis, and an end directed toward the slide member of at least one of the pull cords being connected to the at least one connecting part.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the detailed description and the accompanying drawings, in which.

DETAILED DESCRIPTION OF THE EXEMPLARY EMBODIMENTS

Figure 1:
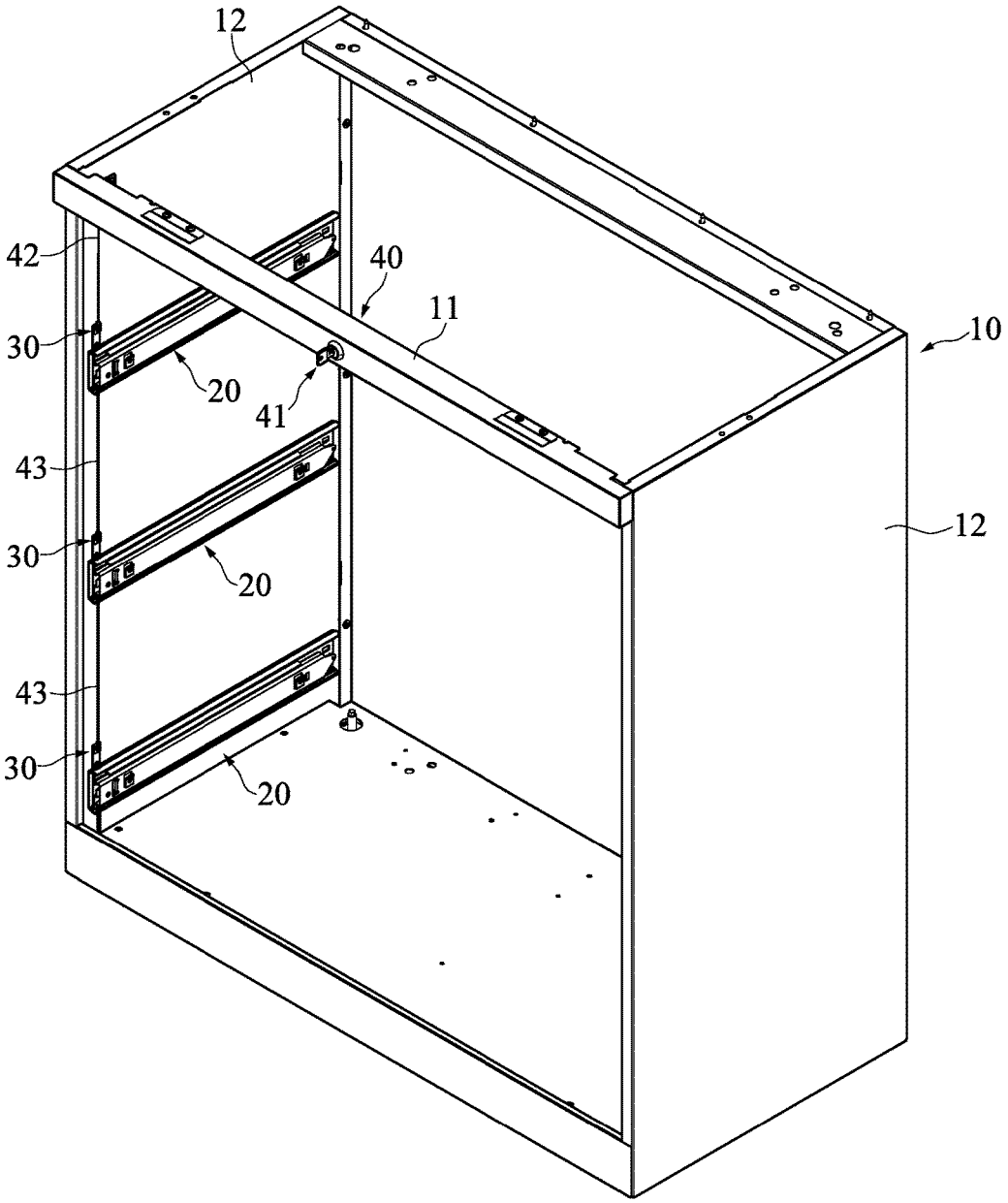
FIG. 1 is an assembled perspective view of a locking device for a slide rail according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
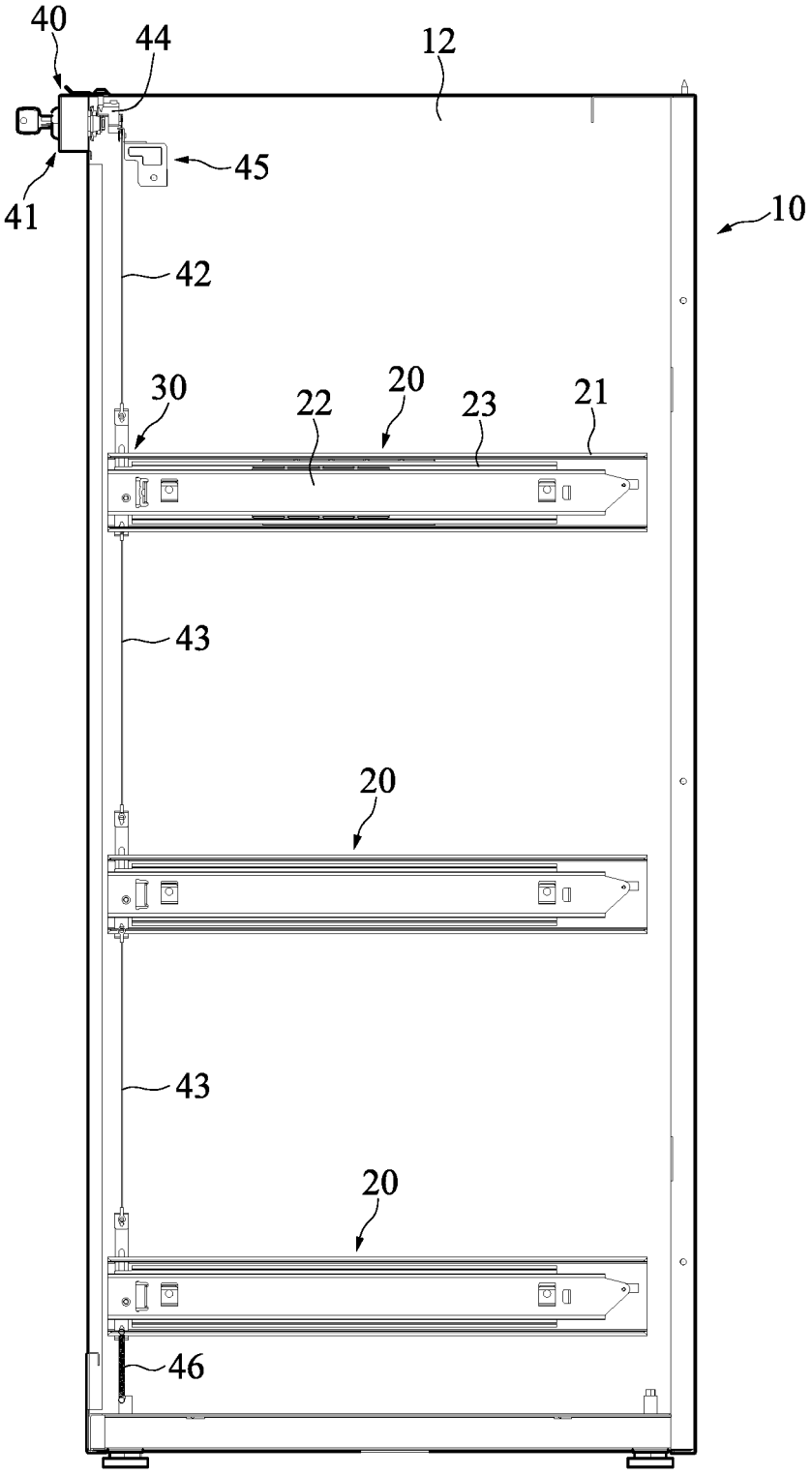
FIG. 2 is a side view of the locking device for a slide rail of FIG. 1 according to the present disclosure.
Figure 3:
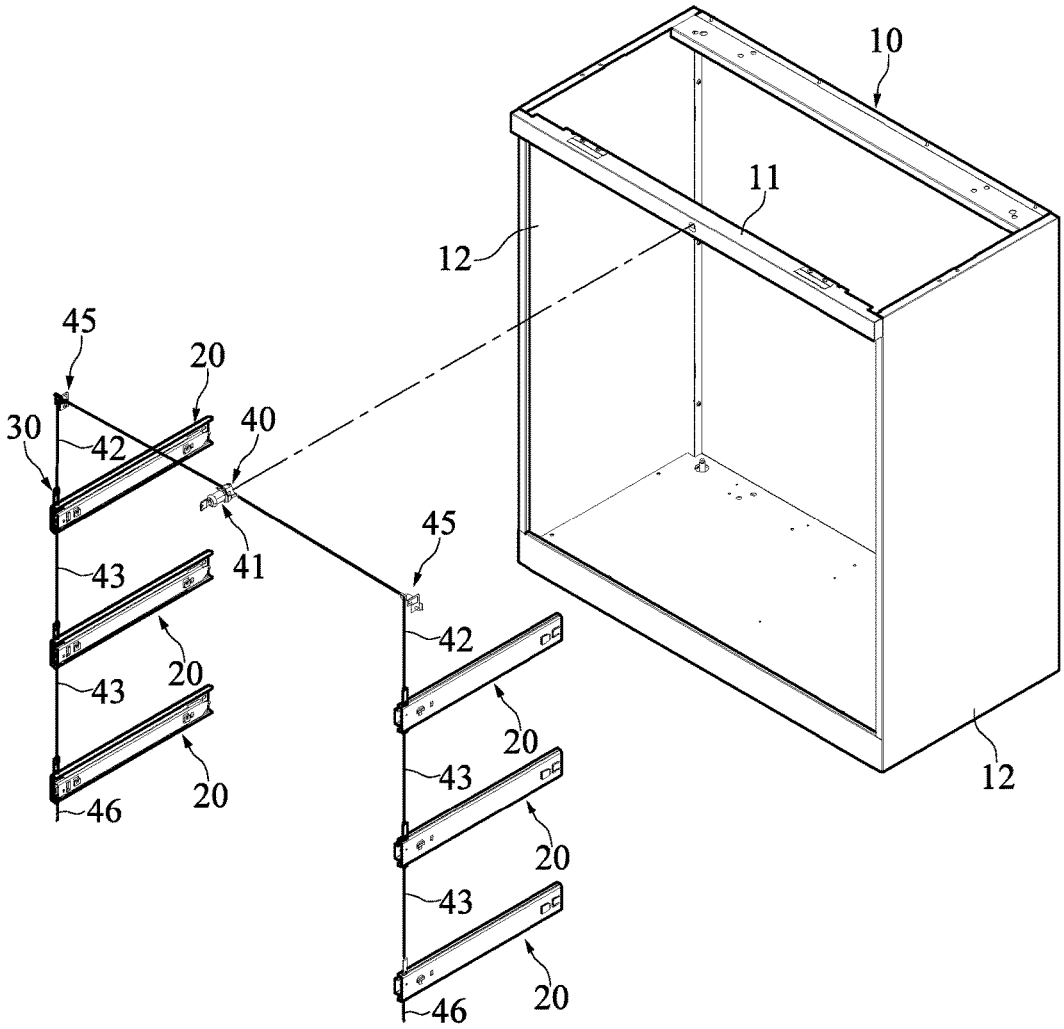
FIG. 3 is a partly exploded perspective view of the locking device for a slide rail of FIG. 1 according to the present disclosure.

Referring to FIG. 1 to FIG. 3, a locking device for a slide rail according to the present disclosure includes a plurality of slide rails 20 that are respectively disposed in a server housing 10, a plurality of locking mechanism 30 that are respectively disposed on the plurality of slide rails, and a plurality of driving mechanisms 40 that drive the plurality of locking mechanisms 30.

The server housing 10 has a support 11 and two opposite side boards 12. A plurality of slide rails 20 are disposed on two opposite inner side surfaces of the two side boards 12. Each of the plurality of slide rails 20 disposed on one of the inner side surfaces of the side boards 12 are substantially equidistant from and parallel to each other, and correspond in position to the plurality of slide rails 20 disposed on the other one of the inner side surfaces of the side boards 12, respectively.

Figure 4:
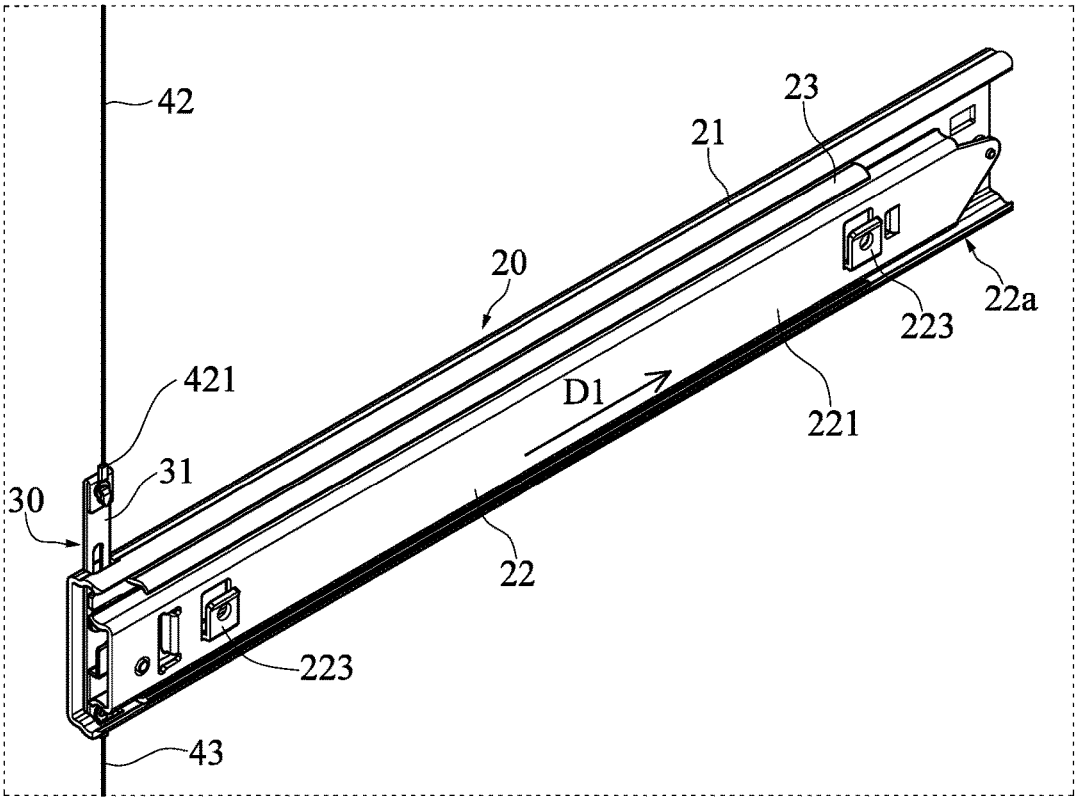
FIG. 4 is an assembled perspective view of the locking device for a slide rail according to the present disclosure with one slide rail and one locking mechanism.
Figure 5:
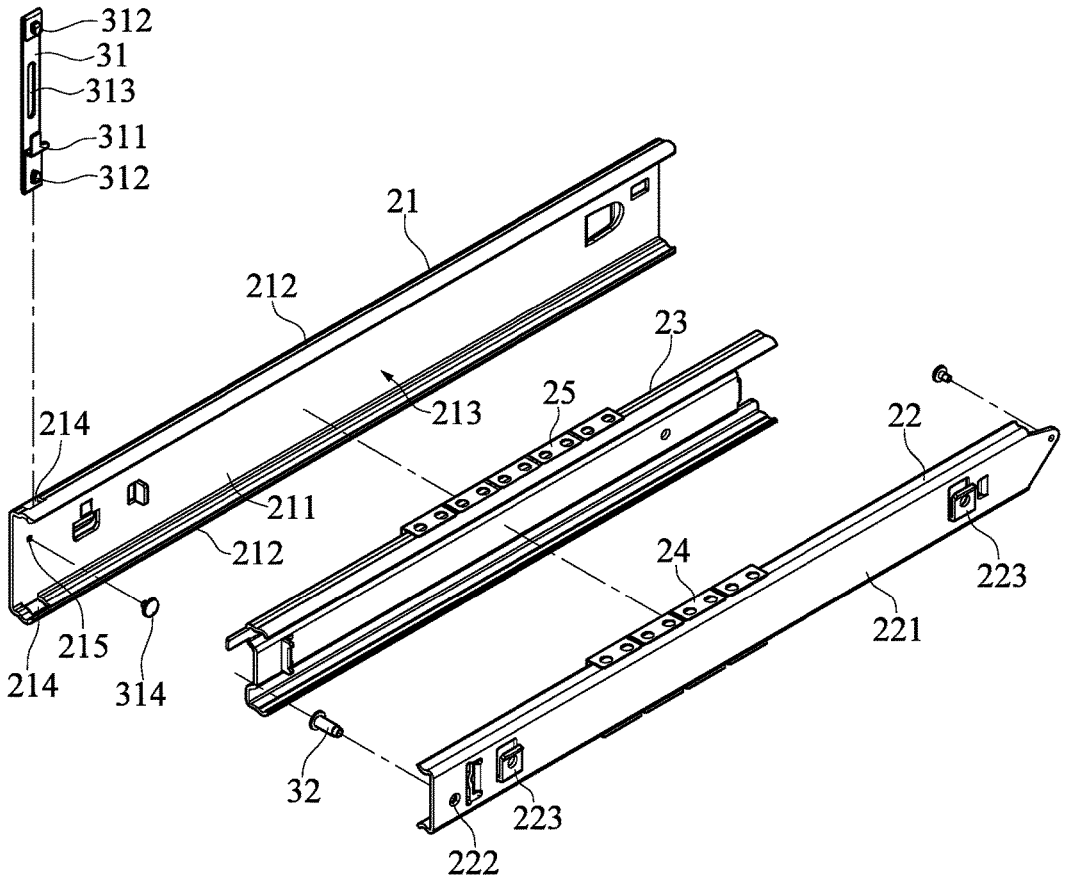
FIG. 5 is an exploded perspective view of the locking device for a slide rail according to the present disclosure with one slide rail and one locking mechanism.
Figure 6:
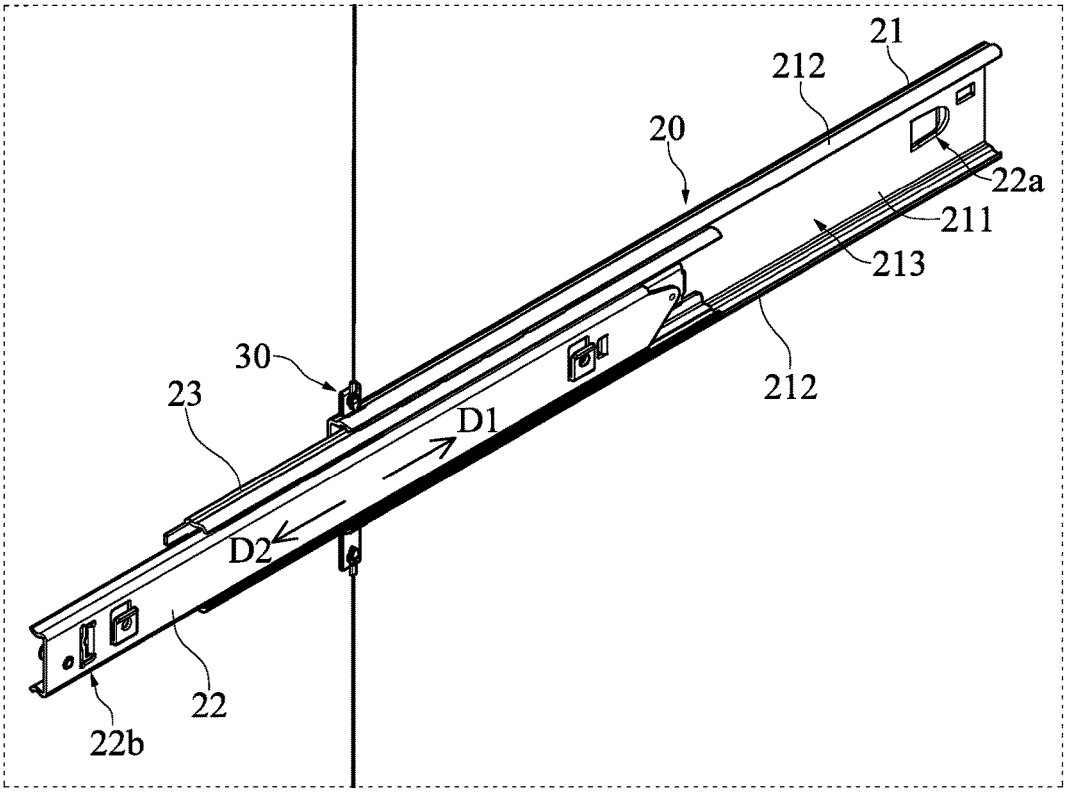
FIG. 6 is a perspective view of the locking device for a slide rail according to the present disclosure with an inner rail being moved to an extended position.

Referring to FIG. 4 to FIG. 6, each of the slide rails 20 has an outer rail 21, an inner rail 22, and a middle rail 23. A plurality of ball retainers 24, 25 and balls (not shown in the figures) are disposed between the inner rail 22 and the middle rail 23, and between the middle rail 23 and the outer rail 21, so that the inner rail 22, the middle rail 23, and the outer rail 21 in rolling contact with each other.

The outer rail 21 of the slide rail 20 is fixedly disposed on the inner side surfaces of the two side boards 12. In the embodiment of the present disclosure, the outer rail 21 includes an outer main board 211 and two outer side boards 212 respectively connected with two opposite long sides of the outer main board 211. The outer main board 211 and the two outer side boards 212 co-define an outer guide groove 213, and the inner rail 22 and the middle rail 23 are accommodated in the outer guide groove 213.

Further referring to FIG. 4 to FIG. 6, the inner rail 22 is disposed in the outer guide groove in a manner that allows the inner rail 22 to move relative to the outer rail 21. An inner main board 221 is formed at a side surface of the inner rail 22 facing the outer rail 21, the inner main board 221 being disposed with a plurality of fastening parts 223 for connecting drawers or server casings within the server housing 10 to the inner rail 22. The inner rail 22 can move relative to the outer rail 21 along a first direction D1 to a retracted position 22*a*, and move relative to the outer rail 21 along a direction opposite to the first direction D1 to an extended position 22*b*. The drawers or server casings are connected to a side surface of the inner rail 22 facing the side board 12, so that the drawers or server casings can move back and forth between the retracted position 22*a* and the extended position 22*b* in the first and second directions D1, D2 along with the inner rail 22. The first direction D1 and the second direction D2 are substantially parallel to the longitudinal direction of the slide rail 20, so that when the inner rail 22 moves along the first and second directions D1, D2, the full length of the slide rail 20 is lengthened or shortened according to the movement of the inner rail 22.

Figure 7:
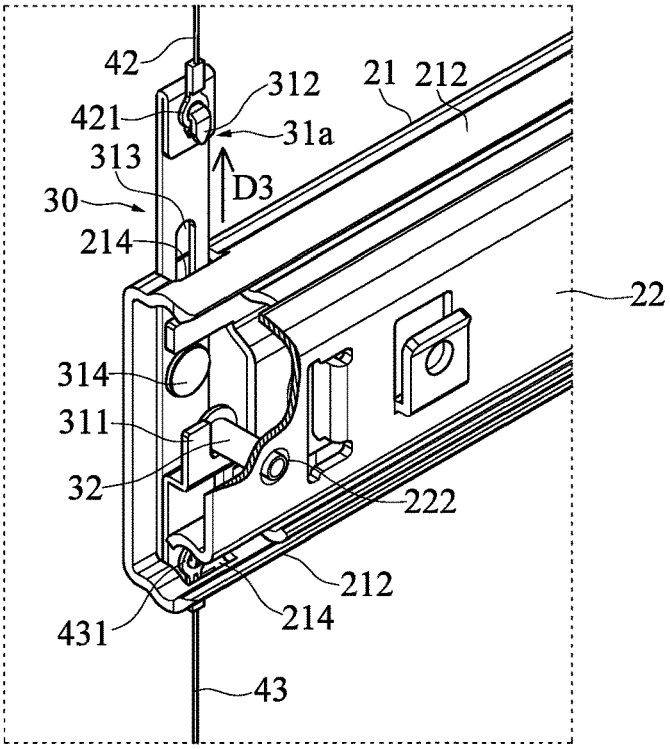
FIG. 7 is a partial enlarged sectional view of the locking device for a slide rail according to the present disclosure in a locked state.
Figure 8:
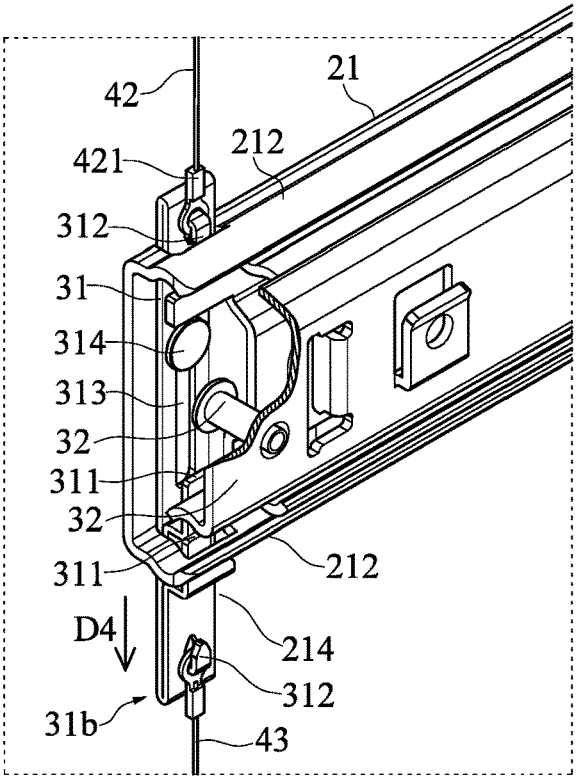
FIG. 8 is a partial enlarged sectional view of the locking device for a slide rail according to the present disclosure in an unlocked state.

Referring to FIG. 5, FIG. 7, and FIG. 8, a guide hole 214 is formed at a position on each of the two outer side boards 212 near an end of the outer rail 21 that is directed toward the second direction. The two guide holes are opposite to each other in position, such as to be arranged on two sides of the outer rail 21 along a direction substantially perpendicular to the longitudinal direction of the slide rail 20. Each of the locking mechanisms 30 is disposed at an end of the slide rail 20 that is directed toward the second direction, and respectively include a slide member 31 and a fastening member 32. The slide member 31 and the fastening member 32 are disposed on the outer rail 21 and the inner rail 22, respectively.

In the embodiment of the present disclosure, the fastening member 32 is a cylindrical peg, and the fastening member 32 is disposed at a side of the inner rail 22 facing the outer rail 21. An end of the fastening member 32 directed toward the inner rail 22 is fixedly disposed in a fixing hole 222 that is formed in the inner main board 221, and an end of the fastening member 32 that is directed toward the inner rail 22 extends toward the outer main board 211 to a position near the slide member 31.

It should be particularly noted that, in other embodiments of the present disclosure, the fastening member 32 can be replaced by other equivalent components to perform a similar function, such as an upward curving stop plate formed integrally from the inner main board 221, or a metal block welded onto the inner main board 221.

The slide member 31 is in the form of a rectangular plate, and a hook 312 is respectively disposed on each of two ends of the slide member 31 in the longitudinal direction of the slide member 31 (i.e., the third or fourth direction). The slide member 31 is formed with a stopping part 311 at a position between the two hooks 312. A side of the stopping part 311 directed toward the first direction D1 is formed with an edge that is substantially perpendicular to the longitudinal direction of the slide rail 20, and an elongated limiting groove 313 is disposed in the slide member 31 along the longitudinal direction of the slide member 31.

When the slide member 31 is disposed on the slide rail 20, the longitudinal direction of the slide member 31 and that of the slide rail 20 are substantially perpendicular to each other. The slide member 31 passes through the two guide holes 214 of the two outer side boards 212, and a guide pin 314 is disposed through the limiting groove 313 of the slide member 31 and is fixedly disposed in a fixing hole 215 that is formed in the outer main board 211. In this way, the slide member 31 is limited to the outer rail 21 in a manner that allows for back-and-forth movement along a direction perpendicular to the longitudinal direction of the slide rail 20.

Referring to FIG. 7 and FIG. 8, through limiting and guiding effects of the two guide holes 214, the limiting groove 313, and the guide pin 314, the slide member 31 can move relative to the outer rail 21 along a straight path that is perpendicular to the longitudinal direction of the slide rail 20. The slide member 31 can move to a fastened position 31*a* along a third direction D3 that is substantially perpendicular to the longitudinal direction of the slide rail 20, or move to a released position 31*b* along a fourth direction D4 that is opposite to the third direction D3.

The position of the stopping part 311 of the slide member 31 and the position of the fastening member 32 work in tandem. As shown in FIG. 7, when the locking mechanism 30 is in a locked state, the inner rail 22 moves to the retracted position 22*a*, the slide member 31 is located at the fastened position 31*a*, the fastening member 32 is located at a side of the stopping part 311 that faces toward the first direction, and the stopping part 311 is on a movement path of the fastening member 32 moving along with the inner rail 22 from the retracted position 22*a* toward the second direction D2. Therefore, the fastening member 32 is obstructed by the stopping part 311, so that the fastening member 32 and the inner rail 22 are fixed in the retracted position 22*a* and are unable to move toward the second direction D2.

Referring to FIG. 8, when the locking mechanism 30 is in an unlocked state, the slide member 31 moves to the released position 31*b*, and the stopping member 311 moves along with the slide member 31 to a position which does not interfere with the fastening member 32. Therefore, the fastening member 32 and the inner rail 22 can be unobstructed so as to enable back-and-forth movement of the inner rail 22 between the retracted position 22*a* and the extended position 22*b*.

Referring to FIG. 1 and FIG. 2, in the embodiment of the present disclosure, the locking mechanisms 30 of the plurality of slide rails 20 disposed on a same one of the side boards 12 are connected to the driving mechanism 40, respectively, so that the locking mechanisms 30 corresponding to each of the slide rails 20 can be driven by the driving mechanisms 40 to be in one of the locked state and the unlocked state. Referring to FIG. 3, the driving mechanism 40 includes a traction mechanism 41, at least one pull cord 42, at least one interlocking cord 43, and at least one coil device 45. The locking mechanism 30 of one of the plurality of slide rails 20 disposed on a same one of the side boards 12 is connected to the traction mechanism 41 by the pull cord 42, and the locking mechanisms 30 corresponding to each of two adjacent ones of the slide rails 20 among the plurality of slide rails 20 disposed on a same one of the side boards 12 are connected to each other through the interlocking cords 43. More specifically, the at least one interlocking cord 43 is respectively connected between two closer ends of the slide members 31 of the locking mechanisms 30 corresponding to each of two adjacent ones of the slide rails 20 that are disposed on a same one of the side boards 12. Therefore, the locking mechanisms 30 corresponding to the plurality of slide rails 20 disposed on a same one of the side boards 12 can be driven synchronously through the interlocking cords 43.

For ease of illustration, among the locking mechanisms 30 corresponding to the plurality of slide rails 20 disposed on a same one of the side boards 12, the locking mechanism 30 that is connected to the traction mechanism 41 by the pull cord is defined as the starting locking mechanism 30 (e.g., the locking mechanism 30 corresponding to the topmost slide rail 20 on the side board 12 in FIG. 3), and among the rest of the locking mechanisms 30 on a same one of the side boards 12, the locking mechanism 30 corresponding to the slide rail 20 furthest away from the starting locking mechanism is defined as the terminal locking mechanism 30 (e.g., the locking mechanism 30 corresponding to the bottommost slide rail 20 on the side board 12 in FIG. 3).

More specifically, the traction mechanism 41 of the driving mechanism 40 is connected to slide member 31 of the starting locking mechanism 30 by the pull cord 42, and the slide member 31 of the starting locking mechanism 30 is further connected to the other driven locking mechanisms 30 by the interlocking cord 43. Therefore, each of the slide members 31 of the locking mechanisms 30 corresponding to the plurality of slide rails 20 disposed on a same one of the side boards 12 can be directly or indirectly driven by the traction mechanism 41 to synchronously move to the fastened position 31*a* or synchronously move to the released position 31*b*, so that the locking mechanisms 30 of the plurality of slide rails 20 can be in one of the locked state and the unlocked state.

Figure 10:
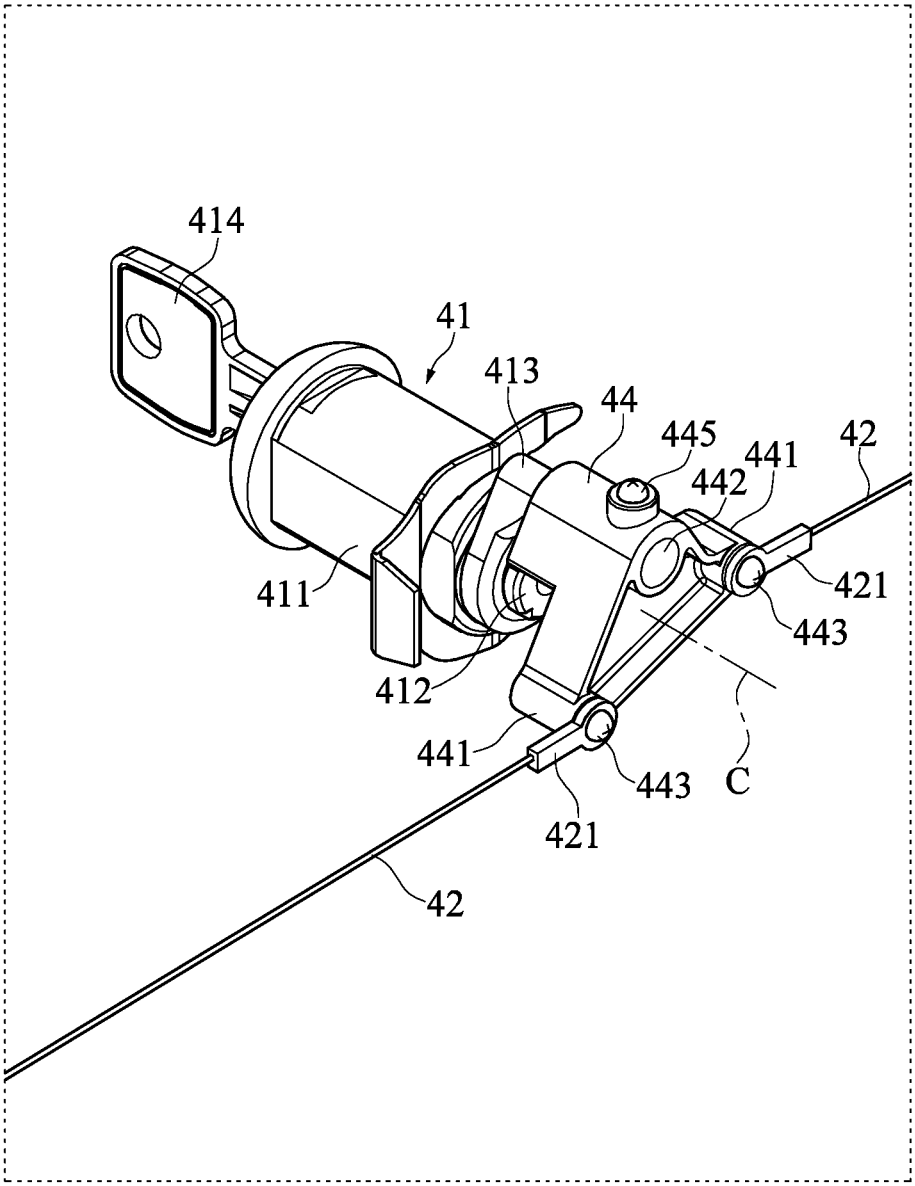
FIG. 10 is a partial enlarged assembled perspective view of a driving mechanism of the locking device for a slide rail according to the present disclosure.
Figure 11:
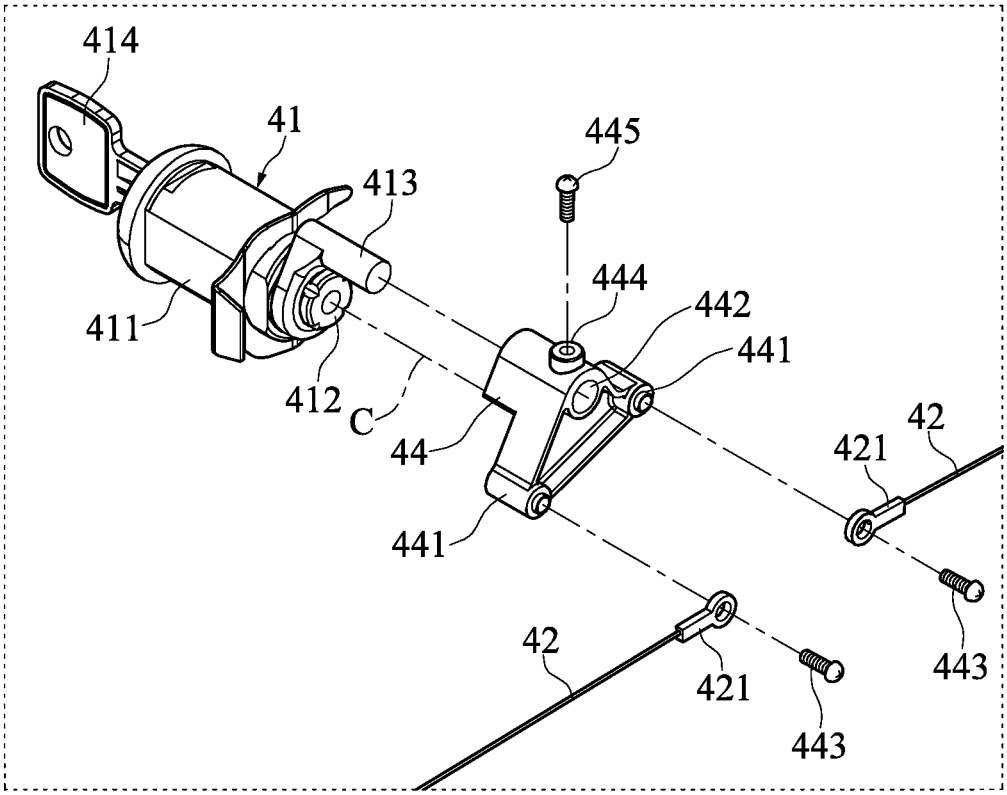
FIG. 11 is a partial enlarged exploded perspective view of a driving mechanism of the locking device for a slide rail according to the present disclosure.

Referring to FIG. 10 and FIG. 11, in the embodiment of the present disclosure, the traction mechanism 41 of the driving mechanism 40 includes a lock core 411 that has a rotation shaft 412. An end of the lock core 411 directed toward the rotation shaft 412 can be inserted with a key 414. A user can unlock the lock core 411 with the key 414, and drive the rotation shaft 412 of the lock core 411 to rotate around a central axis C. Further referring to FIG. 1 and FIG. 3, the lock core 411 of the traction mechanism 41 is disposed on the support 11 of the server housing 10, and the side of the lock core 411 that can be inserted with the key 414 is exposed from a front surface of the server housing 10, so that the user can control the rotation of the rotation shaft 412 from the front of the server housing 10.

The rotation shaft 412 of the lock core 411 has a connection column 413, and a connecting member 44 of the traction mechanism 41 is fixed on the rotation shaft 412 through the connection column 413. In the embodiment of the present disclosure, the connecting member 44 has two connecting parts 441 and an insertion hole 442 disposed between the two connecting parts 441. The connection column 413 of the rotation shaft 412 of the lock core 411 is sleeved within the insertion hole 442, and a side of the connecting member 44 is disposed with a holding screw hole 444 that passes through an outer side surface of the connecting member 44 and communicates with the insertion hole 442. The holding screw hole 444 can be threadedly inserted with a holding screw 445 that passes into the insertion hole 442 and abuts tightly against the surface of the connection column 413 of the rotation shaft 412, so that the connecting member 44 can be fixed to the connection column 413 of the rotation shaft 412. The central axes of the two connecting parts 441 and the rotation shaft 412 do not share a same center of axis, so that when the connecting member 44 is driven by the rotation shaft 412, the two connecting parts of the connecting member 44 can swing pivotally about the central axis C of the rotation shaft 412.

Referring to FIG. 3, FIG. 10 and FIG. 11, two fixing rings 421 are disposed at the two ends of each of the pull cords 42, respectively, one of which can be connected to one of the two connecting parts 441 of the connecting member 44 through a screw bolt 443, so that one end of the pull cord 42 can be connected to the connecting member 44, and that the pull cord 42 can be driven to move when the connecting member 44 is swung by the rotation shaft 412 of the lock core 411.

Figure 9:
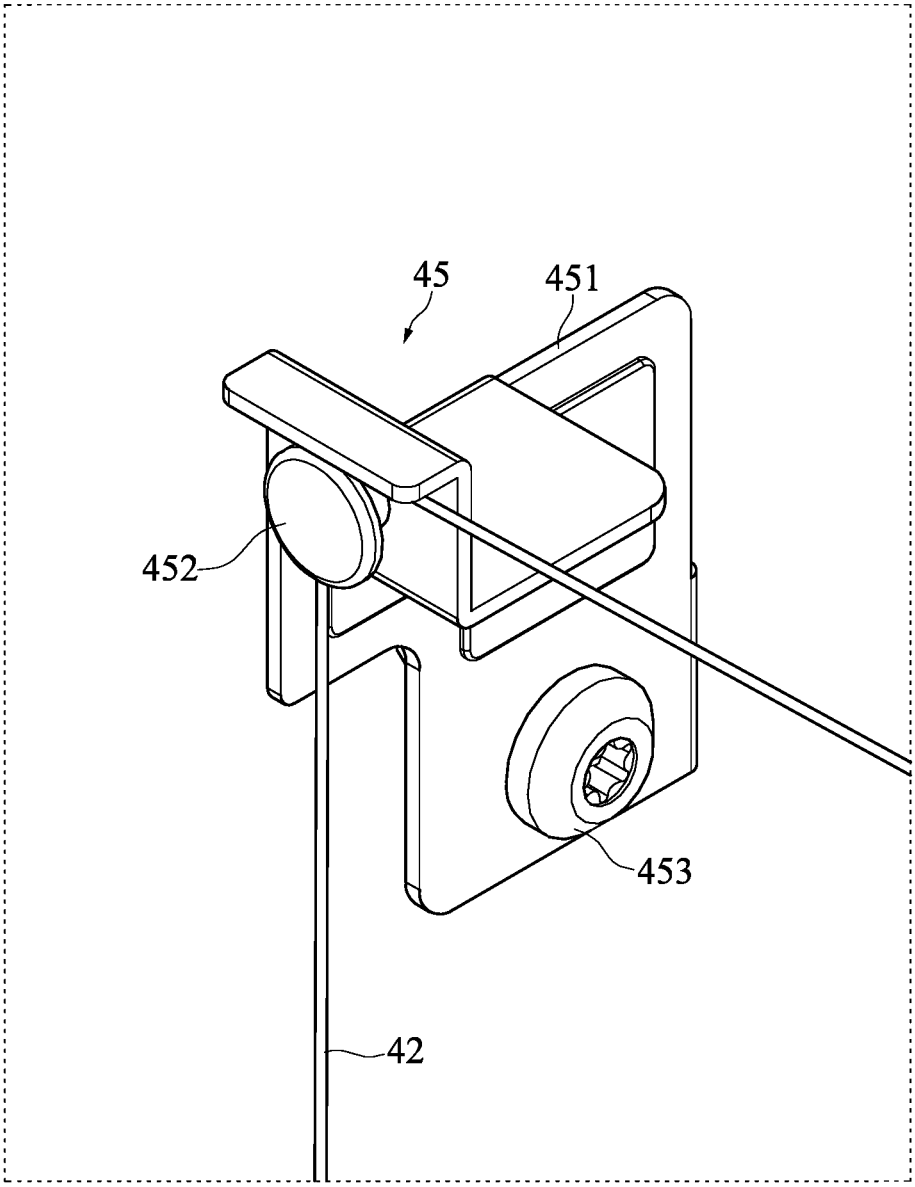
FIG. 9 is a partial enlarged perspective view of a coil device of the locking device for a slide rail according to the present disclosure.
Figure 12:
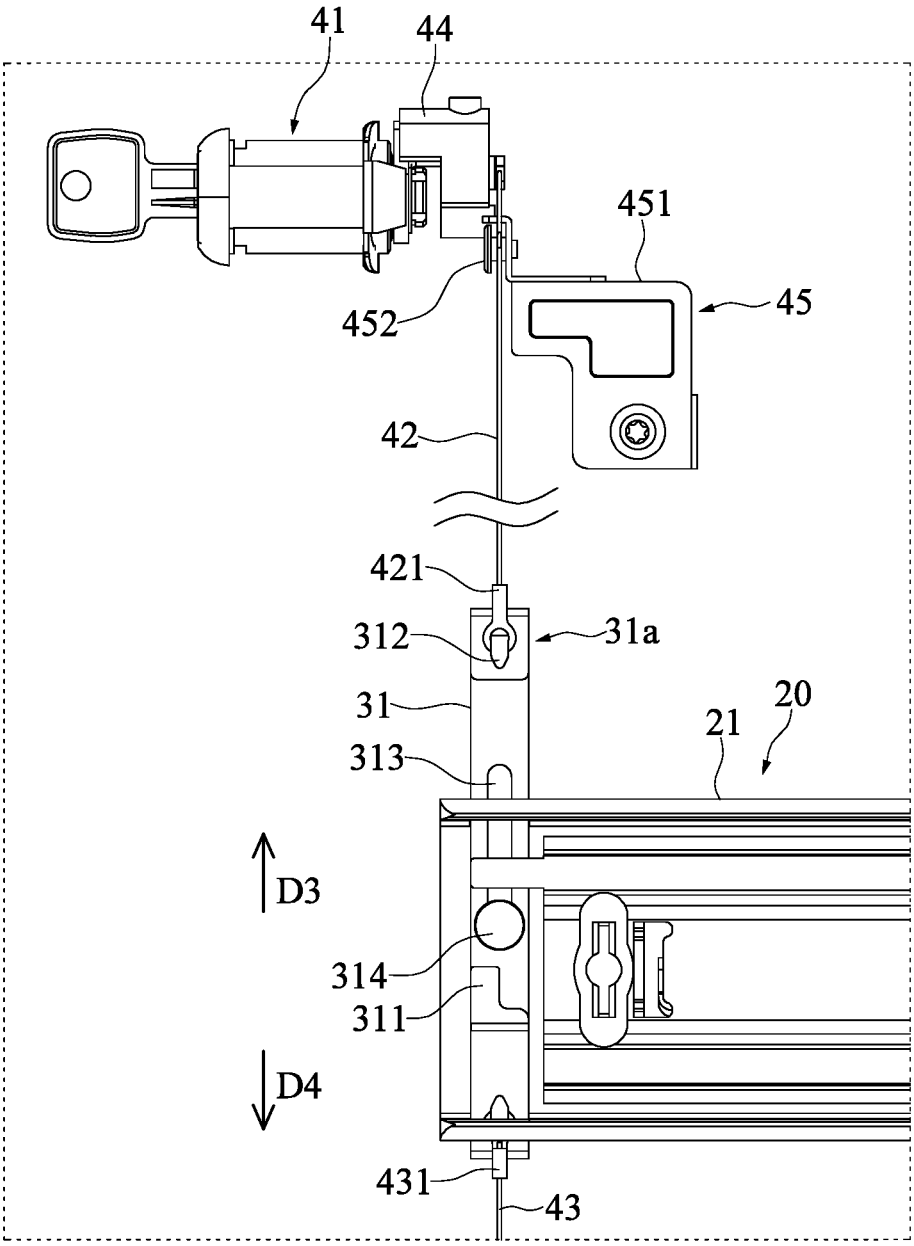
FIG. 12 is a fragmentary schematic view of a traction mechanism and the locking mechanism of the locking device for a slide rail according to the present disclosure in one manner of connection.

Referring to FIG. 7, FIG. 8 and FIG. 12, the fixing ring 421 is disposed at an end of the pull cord 42 other than the end directed toward the traction mechanism 41, and can be hooked with the hook 312 at an end of the slide member 41 directed toward the traction mechanism 41, so that the slide member 31 can be driven by the pull cord 42. Referring to FIG. 3 and FIG. 9, in the embodiment, a coil device 45 is respectively disposed on the extension path of two of the pull cords 42 of the driving mechanism 40 extending from the traction mechanism 41 to the starting locking mechanism 30. Further referring to FIG. 9, the coil device 45 includes a fixed seat 451 made of sheet metal, a guide member 452 disposed on the fixed seat 451 and allowing the pull cord 42 to be wound therearound, and a screw 453 fixing the fixed seat 451 to the inside of the server housing 10. In the embodiment of the present disclosure, the guide member 452 is a round metal rod and has a smooth surface, so that the pull cord 42 can slide upon the smooth surface when being wound on the guide member 452 to produce an effect much like that of a pulley.

Further referring to FIG. 3 to FIG. 9, the positioning of the coil device 45 is substantially parallel to the third or fourth directions D3, D4 and away from the starting locking mechanism 30, so that through the guidance of the coil device 45, the pull cord 42 can extend to the coil device 45 along a direction that is substantially parallel to the third or fourth directions D3, D4 and away from the starting locking mechanism 30, and so that the pull cord 42 can be driven by the traction mechanism 41 and the connecting member 44 to drive the slide member 31 to move along the third or fourth directions D3, D4.

Referring to FIG. 2, FIG. 7 and FIG. 8, in the embodiment, a fixing ring 431 is disposed respectively at the two ends of each of the interlocking cords 43, and the fixing rings 431 at the two ends of each the interlocking cords 43 are connected to the hooks 312 of the slide members 31 of the locking mechanisms 30 of two adjacent ones of the slide rails 20, respectively. Therefore, the slide members 31 of the locking mechanisms 30 of two adjacent ones of the slide rails 20 can be driven synchronously through the interlocking cords 43.

Figure 14:
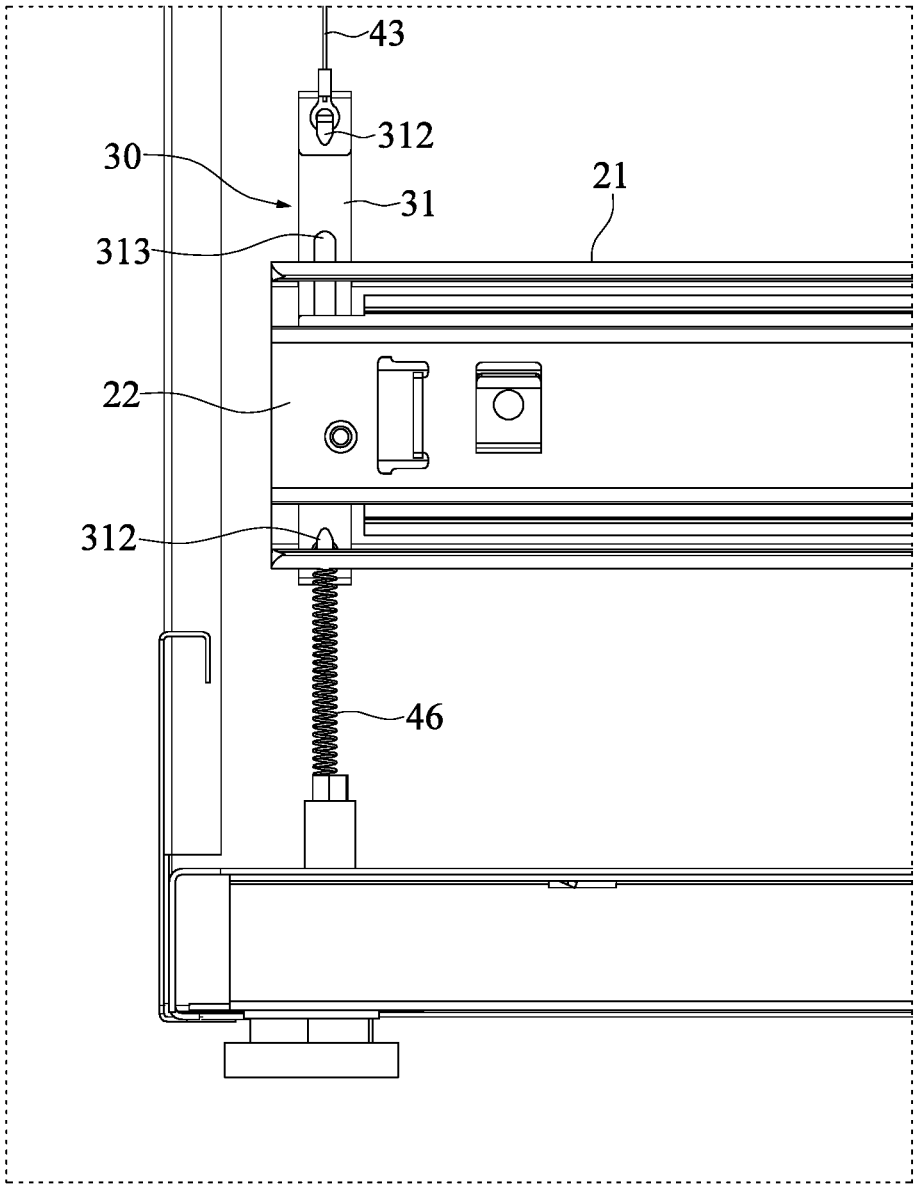
FIG. 14 is a fragmentary schematic view of the driving mechanism of the locking device for a slide rail according to the present disclosure being provided with an elastic member.

Referring to FIG. 2, FIG. 3 and FIG. 14, in the embodiment, the driving mechanism 40 further includes two elastic members 46 connected between the hook 312 of an end of the slide member 31 of the terminal locking mechanism 30 that is directed toward the interlocking cord 43, and the server housing 10. The elastic members 46 are elastic springs, and when the slide member 31 of the terminal locking mechanism 30 is driven by the interlocking cord 43 or the pull cord 42 to move in a direction away from the elastic member 46, the elastic member 46 is stretched to store an elastic strain energy which, when the traction of the pull cord 42 or the interlocking cord 43 ceases, drives the slide member 31 to move in a direction opposite to that of the pull cord 42 or the interlocking cord 43.

It should be particularly noted that the elastic member 46 is not an essential element in the driving mechanism 40, and in other embodiments, the slide member 31 can be unconnected to the elastic member 46, and the slide member 31 may gravitate back to its former position by its own weight when the traction of the pull cord 42 or the interlocking cord 43 ceases.

Referring to FIG. 2, FIG. 3, and FIG. 12, the traction mechanism 41 and the coil device 45 is disposed at a top position of the server housing 10, and the traction mechanism 41 is located at a side of the starting locking mechanism 30 that faces toward the third direction D3, so that when the traction mechanism 41 drives the pull cord 42 to move toward the third direction D3, a traction can be produced by the pull cord 42 to drive slide member 31 of the starting locking mechanism 30 to move along the third direction D3 to the fastened position 31*a*, and the slide members 31 of the other driven locking mechanisms 30 can be driven by the interlocking cords 43 to move synchronously to the fastened position 31*a*. Conversely, when the traction mechanism 41 drives the pull cord 42 to move toward the fourth direction D4, the traction of the pull cord 42 ceases, and the slide members 31 of each of the locking mechanisms 30 can move along the fourth direction D4 to the released position 31*b* by their own weight or by elastic recovery.

Therefore, the locking device for a slide rail of the present disclosure can drive the locking mechanisms 30 on the plurality of slide rails 20 to synchronously be in the locked or unlocked state through the driving mechanism 40. When the plurality of locking mechanisms 30 are in the locked state, the inner rails 22 of the plurality of slide rails 20 are locked in the retracted position 22*a*, so that the drawers or server casings fixed on the plurality of slide rails 20 cannot be drawn out of the server housing 10. When the plurality of locking mechanisms 30 are in the locked state, the inner rails 22 can move freely back and forth between the retracted position 22*a* and the extended position 22*b*, so that the drawers or server casings can be drawn out of the server housing 10.

Furthermore, in the locking device for a slide rail of the present disclosure, the traction mechanism 41 of the driving mechanism 40 has the lock core 411, and a user can only rotate the lock core 411 by using the key 414, so that only authorized personnel with the key 414 can access the server housing 10 to ensure the safety thereof.

In addition, the locking mechanisms 30 adopted by the locking device for a slide rail of the present disclosure have a simple structure, and the pull cords 42 or the interlocking cords 43 connecting each of the locking mechanisms 30 with the driving mechanism 40 are resilient, so that the locking device for a slide rail has simple structure and can be easily accommodated within a limited space (e.g., of a server housing).

The locking device for a slide rail can be in various configurations in different embodiments of the present disclosure. For instance, in FIG. 1 to FIG. 3, the locking mechanisms 30 are disposed on each of the slide rails 20 on the two side boards 12 of the server housing 10, and the traction mechanism 41 of the driving mechanism 40 is respectively connected to the locking mechanism 30 of each of the slide rails 20 on the two side boards 12 through two of the pull cords 42. However, in other embodiments, the locking mechanisms 30 can be disposed only on the slide rails 20 on one of the side boards 12, while the slide rails 20 on the other of the side boards 12 would be absent of any locking mechanisms 30; and the traction mechanism 41 can be connected only to the locking mechanisms 30 of the slide rails 20 on the one of the side boards 12 through the pull cord 42.

As another example, in FIG. 2, FIG. 3 and FIG. 14, the elastic member 46 is connected between the server housing 10 and the terminal locking mechanism 30 among the locking mechanisms 30 of the plurality of slide rails 20 disposed on a same one of the side boards 12. However, in other embodiments, no elastic member 46 is disposed between the terminal locking mechanism 30 and the server housing 10, and the plurality of slide members 31 can, by their own weight, move in a direction opposite to that of the pull cord 42 or the interlocking cord 43 when the traction from the pull cord 42 or the interlocking cord 43 ceases.

Figure 13:
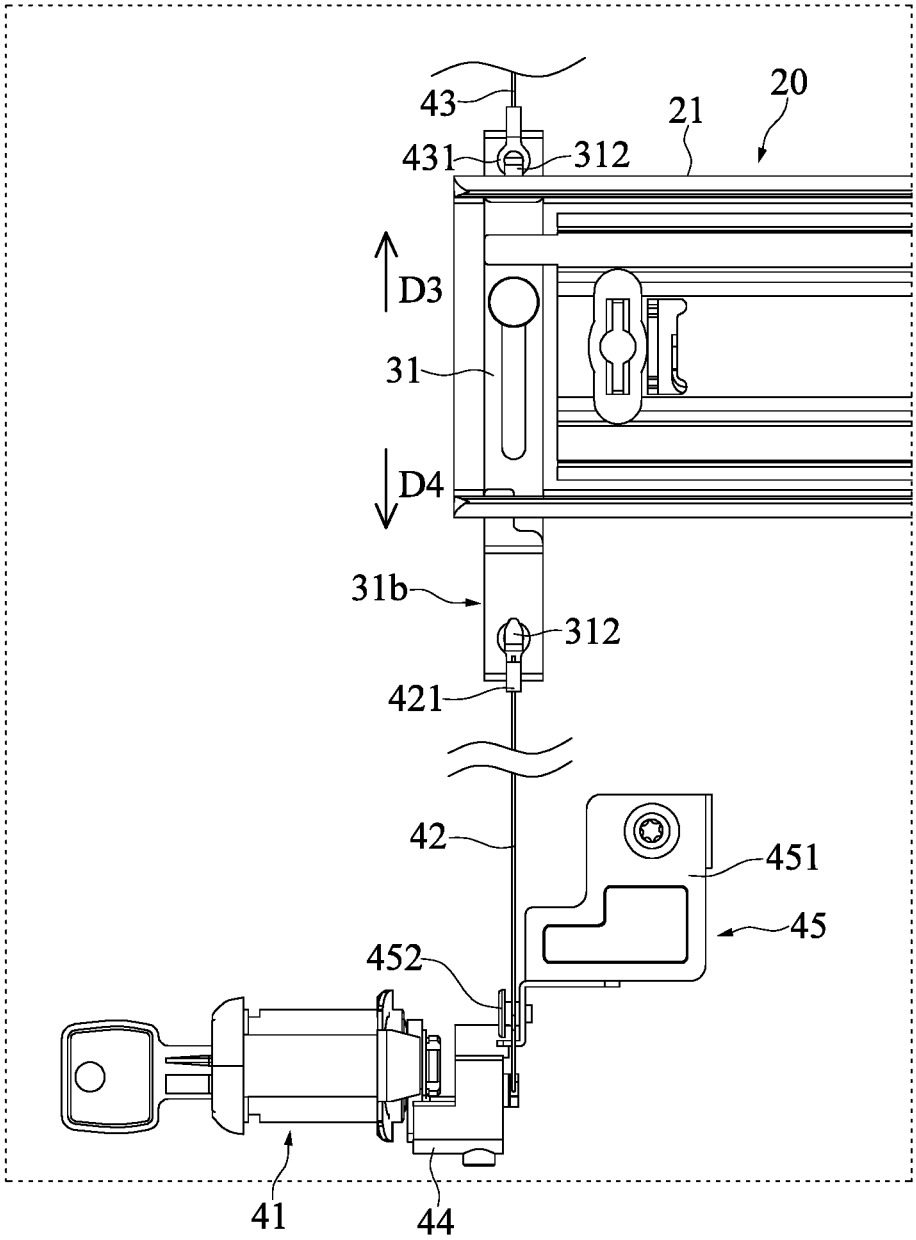
FIG. 13 is a fragmentary schematic view of a traction mechanism and the locking mechanism of the locking device for a slide rail according to the present disclosure in another manner of connection.

In addition, referring to FIG. 13, the traction mechanism 41 and the pull cord 42 can selectively be connected to an end of the slide member 31 of the starting locking mechanism 30 directed toward the fourth direction D4, so that when the pull cord 42 is driven by the traction mechanism 41 to produce a traction, the slide member 31 can be driven to move along the fourth direction D4 to the released position 31*b*. That is to say, the driving mechanism 40 of the embodiment of the present disclosure is configured to synchronously drive the plurality of locking mechanisms 30 to move from the fastened position 31*a* to the released position 31*b* through the traction mechanism 41, the pull cord 42 and the interlocking cord 43, so that the plurality of locking mechanisms 30 are in the unlocked state.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A locking device for a slide rail, comprising:

a slide rail having an outer rail and an inner rail, the inner rail being capable of moving to a retracted position relative to the outer rail along a first direction that is parallel to the longitudinal direction of the slide rail, and moving to an extended position relative to the outer rail along a second direction that is opposite to the first direction;

a locking mechanism including a slide member, a fastening member, and a stopping part formed on the slide member, wherein the slide member is disposed at the outer rail, the fastening member is disposed at the inner rail, the slide member is capable of moving to a fastened position along a third direction that is perpendicular to the longitudinal direction of the slide rail, and moving to a released position along a fourth direction opposite to the third direction; and a driving mechanism including a traction mechanism and a pull cord connecting the traction mechanism and the slide member, the traction mechanism driving the slide member through the pull cord such that the slide member moves to the fastened position or the released position;

wherein when the locking mechanism is in a locked state, the slide member moves to the fastened position, the inner rail moves to the retracted position, and the fastening member is located at a side of the stopping part that faces toward the first direction, so that the fastening member is obstructed by the stopping part when moving along the second direction, and when the locking mechanism is in an unlocked state, the slide member moves to the released position, and the stopping part moves to a position which does not interfere with the fastening member.

2. The locking device for a slide rail according to claim 1, wherein the outer rail has an outer main board, and two outer side boards respectively connected with two opposite long sides of the outer main board, the outer main board and the two outer side boards co-define an outer guide groove, and the inner rail is accommodated in the outer guide groove; wherein each of the two outer side boards of the outer rail is formed with a guide hole, the two guide holes are opposite to each other, and the slide member passes through the two guide holes and is limited by the two guide holes to moving back and forth along a direction perpendicular to the longitudinal direction of the slide rail.

3. The locking device for a slide rail according to claim 2, wherein the pull cord is connected to an end of the slide member that is directed toward the third direction, or connected to an end of the slide member that is directed toward the fourth direction, a limiting groove that is perpendicular to the longitudinal direction of the slide rail is disposed in the slide member, a guide pin is disposed through the limiting groove, and the guide pin is fixed to the outer main board to limit the slide member to the outer rail.

4. The locking device for a slide rail according to claim 3, further comprising a server housing including two side boards, a plurality of the slide rails being disposed on the two side boards, each of the slide rails having one of the locking mechanisms; wherein the driving mechanism further includes at least one interlocking cord respectively connected between two closer ends of the slide members of the locking mechanisms corresponding to each of two adjacent ones of the slide rails that are disposed on a same one of the side boards, so that the locking mechanisms of the plurality of slide rails disposed on the same one of the side boards can be driven synchronously through the interlocking cords.

5. The locking device for a slide rail according to claim 4, wherein a fixing ring is disposed respectively at the two ends of each of the pull cords and interlocking cords, a hook is disposed respectively at two ends in the third or fourth directions of each of the slide members, and the two ends of each of the slide members are respectively connected with the fixing rings of the pull cords or the interlocking cords through the hooks.

6. The locking device for a slide rail according to claim 5, wherein the traction mechanism includes a lock core having a rotation shaft, and a connecting member, the connecting member is connected to the rotation shaft and has at least one connecting part, central axes of the at least one connecting part and the rotation shaft do not share a same center of axis, and an end directed toward the slide member of at least one of the pull cords is connected to the at least one connecting part.

7. The locking device for a slide rail according to claim 6, wherein the driving mechanism further includes a coil device disposed in the server housing at a position between the traction mechanism and the locking mechanism, the coil device having a guide member, and the pull cord being wound on the guide member.

8. The locking device for a slide rail according to claim 6, wherein an end of the fastening member is disposed at a side of the inner rail that faces the outer rail, and an end of the fastening member directed toward the inner rail extends toward the direction of the outer rail.

9. The locking device for a slide rail according to claim 6, wherein among the locking mechanisms corresponding to the plurality of slide rails disposed on a same one of the side boards, the locking mechanism that is connected to the traction mechanism by the pull cord is defined as the starting locking mechanism, and among the rest of the locking mechanisms on a same one of the side boards, the locking mechanism corresponding to the slide rail farthest away from the starting locking mechanism is defined as the terminal locking mechanism; wherein the driving mechanism further includes an elastic member connected between an end of the slide member of the terminal locking mechanism that is directed toward the interlocking cord, and the server housing.

* * * * *